US008152500B2

(12) United States Patent
Beagle et al.

(10) Patent No.: US 8,152,500 B2
(45) Date of Patent: Apr. 10, 2012

(54) SCROLL COMPRESSOR BUILD ASSEMBLY

(75) Inventors: Wayne P. Beagle, Chittenango, NY (US); James W. Bush, Skaneateles, NY (US)

(73) Assignee: Bitzer Scroll Inc., East Syracuse, NY (US)

( * ) Notice: Subject to any disclaimer, the term of this patent is extended or adjusted under 35 U.S.C. 154(b) by 763 days.

(21) Appl. No.: 12/015,596

(22) Filed: Jan. 17, 2008

(65) Prior Publication Data

US 2009/0185932 A1 Jul. 23, 2009

(51) Int. Cl.
*F01C 1/02* (2006.01)
*F01C 1/063* (2006.01)
*F04C 2/00* (2006.01)

(52) U.S. Cl. ..... 418/55.1

(58) Field of Classification Search ..... 418/55.1–55.6
See application file for complete search history.

(56) References Cited

U.S. PATENT DOCUMENTS

| | | | | |
|---|---|---|---|---|
| 4,431,388 | A * | 2/1984 | Eber et al. | 418/55.1 |
| 4,655,696 | A | 4/1987 | Utter | |
| 4,696,630 | A | 9/1987 | Sakata et al. | |
| 4,927,339 | A | 5/1990 | Riffe et al. | |
| 5,090,878 | A | 2/1992 | Haller | |
| 5,320,506 | A | 6/1994 | Fogt | |
| 5,427,511 | A | 6/1995 | Caillat et al. | |
| 5,582,312 | A | 12/1996 | Niles et al. | |
| 6,056,524 | A * | 5/2000 | Williams et al. | 418/55.1 |
| 6,113,371 | A * | 9/2000 | Williams et al. | 418/55.1 |
| 6,193,484 | B1 * | 2/2001 | Hahn et al. | 418/55.1 |
| 6,227,830 | B1 | 5/2001 | Fields et al. | |
| 6,267,573 | B1 * | 7/2001 | Fenocchi et al. | 418/55.5 |
| 6,280,154 | B1 * | 8/2001 | Clendenin et al. | 417/410.5 |
| 6,398,530 | B1 | 6/2002 | Hasemann | |
| 6,439,867 | B1 | 8/2002 | Clendenin | |
| 6,488,489 | B2 | 12/2002 | Williams et al. | |
| 6,672,846 | B2 * | 1/2004 | Rajendran et al. | 417/410.5 |
| 6,682,327 | B2 | 1/2004 | Milliff et al. | |
| 6,761,541 | B1 | 7/2004 | Clendenin | |
| 6,814,551 | B2 | 11/2004 | Kammhoff et al. | |
| 6,960,070 | B2 | 11/2005 | Kammhoff et al. | |
| 7,112,046 | B2 | 9/2006 | Kammhoff et al. | |
| 2004/0126261 | A1 | 7/2004 | Kammhoff et al. | |
| 2005/0232800 | A1 | 10/2005 | Kammhoff et al. | |

FOREIGN PATENT DOCUMENTS

| | | | |
|---|---|---|---|
| EP | 0 432 083 A1 | | 6/1991 |
| JP | 63309794 | | 12/1988 |
| JP | 63309794 A | * | 12/1988 |
| JP | 03233181 A | * | 10/1991 |
| JP | 06026468 | | 2/1994 |
| JP | 06221280 A | * | 8/1994 |
| JP | 07158577 | | 6/1995 |

(Continued)

OTHER PUBLICATIONS

U.S. Appl. No. 12/015,571, filed Jan. 17, 2008, Duppert et al.

(Continued)

*Primary Examiner* — Mary A Davis
(74) *Attorney, Agent, or Firm* — Reinhart Boerner Van Deuren P.C.

(57) ABSTRACT

A scroll compressor build assembly is provided. An outer housing includes multiple shell sections that interfit to provide internal steps that provide seating surfaces. One or both bearing members can use the internal seats. The outer housing may comprise three shells that telescopically interfit and that can be welded with circumferential welds.

13 Claims, 16 Drawing Sheets

FOREIGN PATENT DOCUMENTS

| | | |
|---|---|---|
| JP | 09151869 | 6/1997 |
| JP | 2001082354 | 3/2001 |
| WO | WO 99/31355 A1 | 6/1999 |

OTHER PUBLICATIONS

U.S. Appl. No. 12/015,557, filed Jan. 17, 2008, Bush.
U.S. Appl. No. 12/015,689, filed Jan. 17, 2008, Beagle et al.
U.S. Appl. No. 12/015,589, filed Jan. 17, 2008, Bush et al.
U.S. Appl. No. 12/015,592, filed Jan. 17, 2008, Bush et al.
U.S. Appl. No. 12/015,599, filed Jan. 17, 2008, Bush.
U.S. Appl. No. 12/015,643, filed Jan. 17, 2008, Duppert et al.
U.S. Appl. No. 12/015,651, filed Jan. 17, 2008, Duppert et al.
U.S. Appl. No. 12/015,660, filed Jan. 17, 2008, Beagle et al.

* cited by examiner

SCROLL COMPRESSOR BUILD ASSEMBLY

FIELD OF THE INVENTION

The present invention generally relates to scroll compressors for compressing refrigerant and more particularly relates to housing shells for enclosing scroll assembly components and/or to support of bearing members and motor assemblies within a housing.

BACKGROUND OF THE INVENTION

A scroll compressor is a certain type of compressor that is used to compress refrigerant for such applications as refrigeration, air conditioning, industrial cooling and freezer applications, and/or other applications where compressed fluid may be used. Such prior scroll compressors are known, for example, as exemplified in U.S. Pat. No. 6,398,530 to Hasemann; U.S. Pat. No. 6,814,551, to Kammhoff et al.; U.S. Pat. No. 6,960,070 to Kammhoff et al.; and U.S. Pat. No. 7,112,046 to Kammhoff et al., all of which are assigned to a Bitzer entity closely related to the present assignee. As the present disclosure pertains to improvements that can be implemented in these or other scroll compressor designs, the entire disclosures of U.S. Pat. Nos. 6,398,530; 7,112,046; 6,814,551; and 6,960,070 are hereby incorporated by reference in their entireties.

As is exemplified by these patents, scroll compressors conventionally include an outer housing having a scroll compressor contained therein. A scroll compressor includes first and second scroll compressor members. A first compressor member is typically arranged stationary and fixed in the outer housing. A second scroll compressor member is moveable relative to the first scroll compressor member in order to compress refrigerant between respective scroll ribs which rise above the respective bases and engage in one another. Conventionally the moveable scroll compressor member is driven about an orbital path about a central axis for the purposes of compressing refrigerant. An appropriate drive unit, typically an electric motor, is provided usually within the same housing to drive the movable scroll member.

The present invention is directed towards improvements in the build assembly over prior scroll compressor.

BRIEF SUMMARY OF THE INVENTION

In one aspect, the invention provides a scroll compressor in which shell sections telescopically interfit to support at least one of the bearing members. The scroll compressor includes a housing including first and second shell sections that are telescopically interfitted to define an annular seat internal of the housing. The scroll compressor also includes scroll compressor bodies having respective bases and respective scroll ribs that project from the respective bases and which mutually engage. A motor provides a rotational output on a drive shaft, with the drive shaft operatively driving one of the scroll compressor bodies to facilitate relative movement for the compression of fluid. A bearing member rotatably supports the drive shaft with the bearing member engaging the seat.

An embodiment in accordance with the above aspect can be that the first and second housing sections are upper and central housing sections supporting an upper bearing member. Another embodiment in accordance with the above aspect can be that the first and second housing sections are lower and central housing section supporting a lower bearing member.

In yet another aspect, the invention provides an outer housing for a scroll compressor in which three housing sections are telescopically interfitted. According to this aspect, a scroll compressor includes: a housing including an upper shell section, a lower shell section and a tubular central shell section. The upper and lower shell sections are telescopically interfitted with opposed ends of the tubular central shell section. Scroll compressor bodies are enclosed in the housing. The scroll compressor bodies have respective bases and respective scroll ribs that project from the respective bases and which mutually engage. A drive unit enclosed in the housing provides a rotational output toward the scroll compressor bodies to facilitate relative movement for the compression of fluid.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
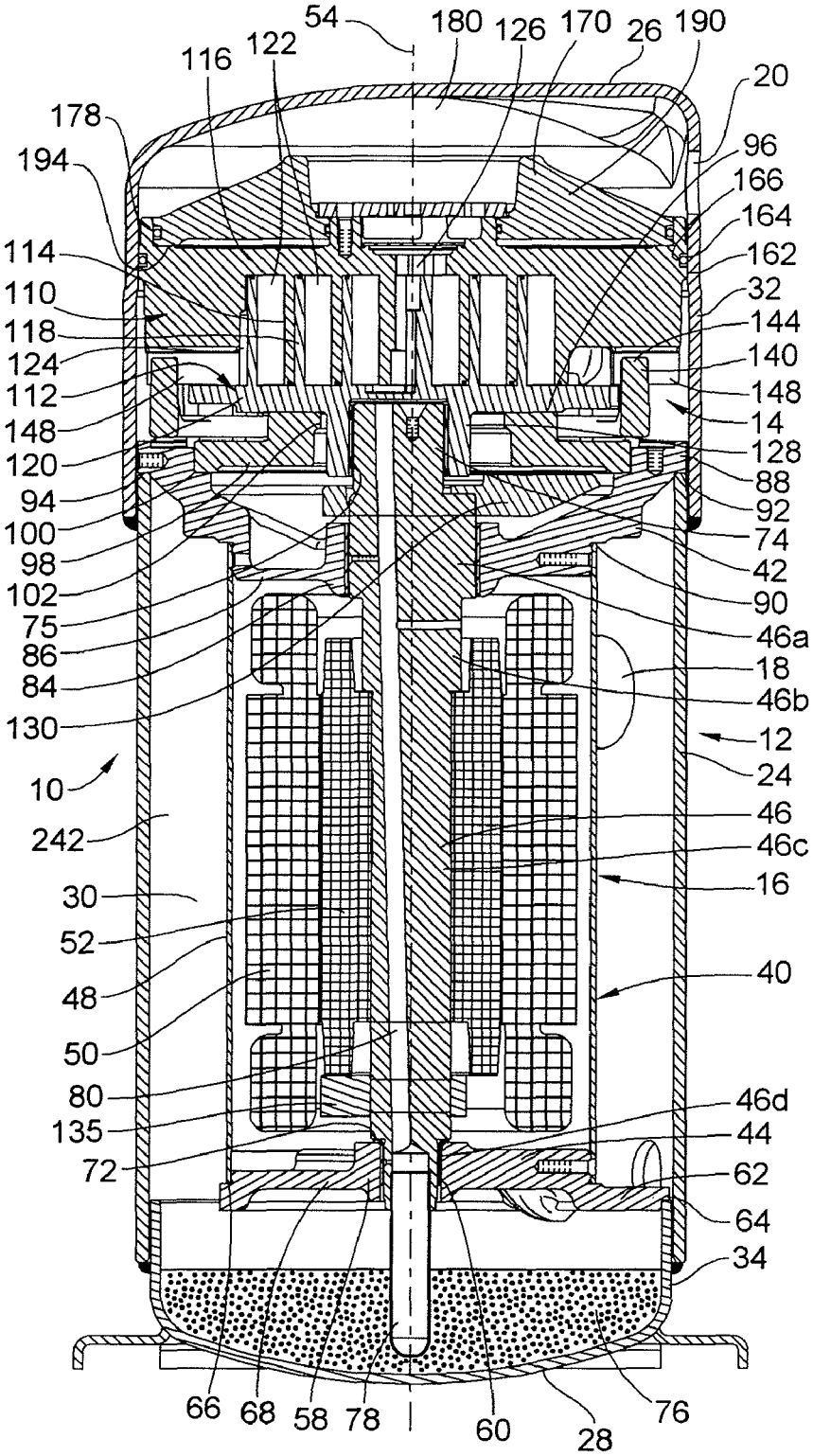
FIG. 1 is a cross section of a scroll compressor assembly in accordance with an embodiment of the present invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

An embodiment of the present invention is illustrated in the figures as a scroll compressor assembly 10 generally including an outer housing 12 in which a scroll compressor 14 can be driven by a drive unit 16. The scroll compressor assembly may be arranged in a refrigerant circuit for refrigeration, industrial cooling, freezing, air conditioning or other appropriate applications where compressed fluid is desired. Appropriate connection ports provide for connection to a refrigeration circuit and include a refrigerant inlet port 18 and a refrigerant outlet port 20 extending through the outer housing 12. The scroll compressor assembly 10 is operable through operation of the drive unit 16 to operate the scroll compressor 14 and thereby compress an appropriate refrigerant or other fluid that enters the refrigerant inlet port 18 and exits the refrigerant outlet port 20 in a compressed high pressure state.

The outer housing 12 may take many forms. In the preferred embodiment, the outer housing includes multiple shell sections and preferably three shell sections to include a central cylindrical housing section 24, a top end housing section 26 and a bottom end housing section 28. Preferably, the housing sections 24, 26, 28 are formed of appropriate sheet steel and welded together to make a permanent outer housing 12 enclosure. However, if disassembly of the housing is desired, other housing provisions can be made that can include metal castings or machined components.

The central housing section 24 is preferably cylindrical and telescopically interfits with the top and bottom end housing sections 26, 28. This forms an enclosed chamber 30 for housing the scroll compressor 14 and drive unit 16. Each of the top and bottom end housing sections 26, 28 are generally dome shaped and include respective cylindrical side wall regions 32, 34 to mate with the center section 24 and provide for closing off the top and bottom ends of the outer housing 12. As can be seen in FIG. 1, the top side wall region 32 telescopically overlaps the central housing section 24 and is exteriorly welded along a circular welded region to the top end of the central housing section 24. Similarly the bottom side wall region 34 of the bottom end housing section 28 telescopically interfits with the central housing section 24 (but is shown as being installed into the interior rather than the exterior of the central housing section 24) and is exteriorly welded by a circular weld region.

The drive unit 16 may preferably take the form of an electrical motor assembly 40, which is supported by upper and lower bearing members 42, 44. The motor assembly 40 operably rotates and drives a shaft 46. The electrical motor assembly 40 generally includes an outer annular motor housing 48, a stator 50 comprising electrical coils and a rotor 52 that is coupled to the drive shaft 46 for rotation together. Energizing the stator 50 is operative to rotatably drive the rotor 52 and thereby rotate the drive shaft 46 about a central axis 54.

Figure 4:
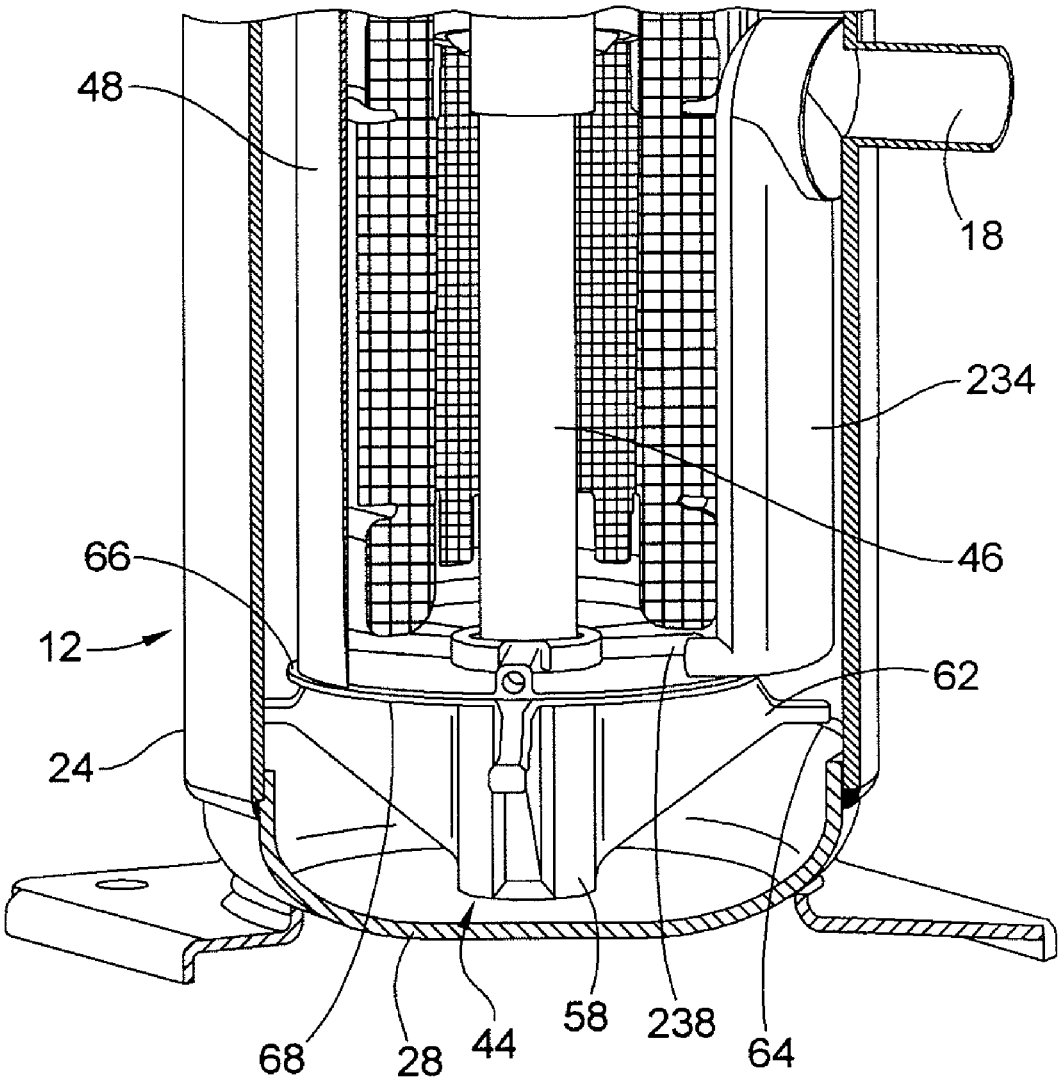
FIG. 4 is a partial cross section and cut-away view of a lower portion of the embodiment of FIG. 1.

With reference to FIGS. 1 and 4, the lower bearing member 44 includes a central generally cylindrical hub 58 that includes a central bushing and opening to provide a cylindrical bearing 60 to which the drive shaft 46 is journaled for rotational support. A plurality of arms 62 and typically at least three arms project radially outward from the bearing central hub 58 preferably at equally spaced angular intervals. These support arms 62 engage and are seated on a circular seating surface 64 provided by the terminating circular edge of the bottom side wall region 34 of the bottom outer housing section 28. As such, the bottom housing section 28 can serve to locate, support and seat the lower bearing member 44 and thereby serves as a base upon which the internal components of the scroll compressor assembly can be supported.

The lower bearing member 44 in turn supports the cylindrical motor housing 48 by virtue of a circular seat 66 formed on a plate-like ledge region 68 of the lower bearing member 44 that projects outward along the top of the central hub 58. The support arms 62 also preferably are closely toleranced relative to the inner diameter of the central housing section. The arms 62 may engage with the inner diameter surface of the central housing section 24 to centrally locate the lower bearing member 44 and thereby maintain position of the central axis 54. This can be by way of an interference and press-fit support arrangement between the lower bearing member 44 and the outer housing 12 (See e.g. FIG. 4). Alternatively according to a more preferred configuration, as shown in FIG. 1, the lower bearing engages with the lower housing section 28 which is in turn attached to center section 24. Likewise, the outer motor housing 48 may be supported with an interference and press-fit along the stepped seat 66 of the lower bearing member 44. As shown, screws may be used to securely fasten the motor housing to the lower bearing member 44.

The drive shaft 46 is formed with a plurality of progressively smaller diameter sections 46*a*-46*d* which are aligned concentric with the central axis 54. The smallest diameter section 46*d* is journaled for rotation within the lower bearing member 44 with the next smallest section 46*c* providing a step 72 for axial support of the drive shaft 46 upon the lower bearing member 44. The largest section 46*a* is journaled for rotation within the upper bearing member 42.

The drive shaft 46 further includes an offset eccentric drive section 74 that has a cylindrical drive surface 75 about an offset axis that is offset relative to the central axis 54. This offset drive section 74 is journaled within a cavity of the movable scroll member of the scroll compressor 14 to drive the movable member of the scroll compressor about an orbital path when the drive shaft 46 is spun about the central axis 54. To provide for lubrication of all of these bearing surfaces, the outer housing 12 provides an oil lubricant sump 76 at the bottom end in which suitable oil lubricant is provided. The drive shaft 46 has an oil lubricant pipe and impeller 78 that acts as an oil pump when the drive shaft is spun and thereby pumps oil out of the lubricant sump 76 into an internal lubricant passageway 80 defined within the drive shaft 46. During rotation of the drive shaft 46, centrifugal force acts to drive lubricant oil up through the lubricant passageway 80 against the action of gravity. The lubricant passageway 80 includes various radial passages as shown to feed oil through centrifugal force to appropriate bearing surfaces and thereby lubricate sliding surfaces as may be desired.

The upper bearing member 42 includes a central bearing hub 84 into which the largest section 46*a* of the drive shaft 46 is journaled for rotation. Extending outward from the bearing hub 84 is a support web 86 that merges into an outer peripheral support rim 88. Provided along the support web 86 is an annular stepped seating surface 90 which may have an interference and press-fit with the top end of the cylindrical motor housing 48 to thereby provide for axial and radial location. The motor housing 48 may also be fastened with screws to the upper bearing member 42. The outer peripheral support rim 88 also may include an outer annular stepped seating surface 92 which may have an interference and press-fit with the outer housing 12. For example, the outer peripheral rim 88 can engage the seating surface 92 axially, that is it engages on a lateral plane perpendicular to axis 54 and not through a diameter. To provide for centering there is provided a diametric fit just below the surface 92 between the central housing section 24 and the support rim 88. Specifically, between the telescoped central and top-end housing sections 24, 26 is defined in internal circular step 94, which is located axially and radially with the outer annular step 92 of the upper bearing member 42.

The upper bearing member 42 also provides axial thrust support to the movable scroll member through a bearing support via an axial thrust surface 96. While this may be integrally provided by a single unitary component, it is shown as being provided by a separate collar member 98 that is interfit with the upper portion of the upper bearing member 42 along stepped annular interface 100. The collar member 98 defines a central opening 102 that is a size large enough to provide for receipt of the eccentric offset drive section 74 and allow for orbital eccentric movement thereof that is provided within a receiving portion of the movable scroll compressor member 112.

Turning in greater detail to the scroll compressor 14, the scroll compressor body is provided by first and second scroll compressor bodies which preferably include a stationary fixed scroll compressor body 110 and a movable scroll compressor body 112. The moveable scroll compressor body 112 is arranged for orbital movement relative to the fixed scroll compressor body 110 for the purpose of compressing refrigerant. The fixed scroll compressor body includes a first rib 114 projecting axially from a plate-like base 116 and is designed in the form of a spiral. Similarly, the second movable scroll compressor body 112 includes a second scroll rib 118 projecting axially from a plate-like base 120 and is in the design form of a similar spiral. The scroll ribs 114, 118 engage in one another and abut sealingly on the respective base surfaces 120, 116 of the respectively other compressor body 112, 110. As a result, multiple compression chambers 122 are formed between the scroll ribs 114, 118 and the bases 120, 116 of the compressor bodies 112, 110. Within the chambers 122, progressive compression of refrigerant takes place. Refrigerant flows with an initial low pressure via an intake area 124 surrounding the scroll ribs 114, 118 in the outer radial region (see e.g. FIGS. 2-3). Following the progressive compression in the chambers 122 (as the chambers progressively are defined radially inward), the refrigerant exits via a compression outlet 126 which is defined centrally within the base 116 of the fixed scroll compressor body 110. Refrigerant that has been compressed to a high pressure can exit the chambers 122 via the compression outlet 126 during operation of the scroll compressor.

The movable scroll compressor body 112 engages the eccentric offset drive section 74 of the drive shaft 46. More specifically, the receiving portion of the movable scroll compressor body 112 includes a cylindrical bushing drive hub 128 which slideably receives the eccentric offset drive section 74 with a slideable bearing surface provided therein. In detail, the eccentric offset drive section 74 engages the cylindrical drive hub 128 in order to move the moveable scroll compressor body 112 about an orbital path about the central axis 54 during rotation of the drive shaft 46 about the central axis 54. Considering that this offset relationship causes a weight imbalance relative to the central axis 54, the assembly preferably includes a counter weight 130 that is mounted at a fixed angular orientation to the drive shaft 46. The counter weight 130 acts to offset the weight imbalance caused by the eccentric offset drive section 74 and the movable scroll compressor body 112 that is driven about an orbital path (e.g. among other things, the scroll rib is not equally balanced). The counter weight 130 includes an attachment collar 132 and an offset weight region 134 (see counter weight shown best in FIG. 2) that provides for the counter weight effect and thereby balancing of the overall weight of the rotating components about the central axis 54 in cooperation with a lower counterweight 135 for balancing purposes. This provides for reduced vibration and noise of the overall assembly by internally balancing or cancelling out inertial forces.

Figure 2:
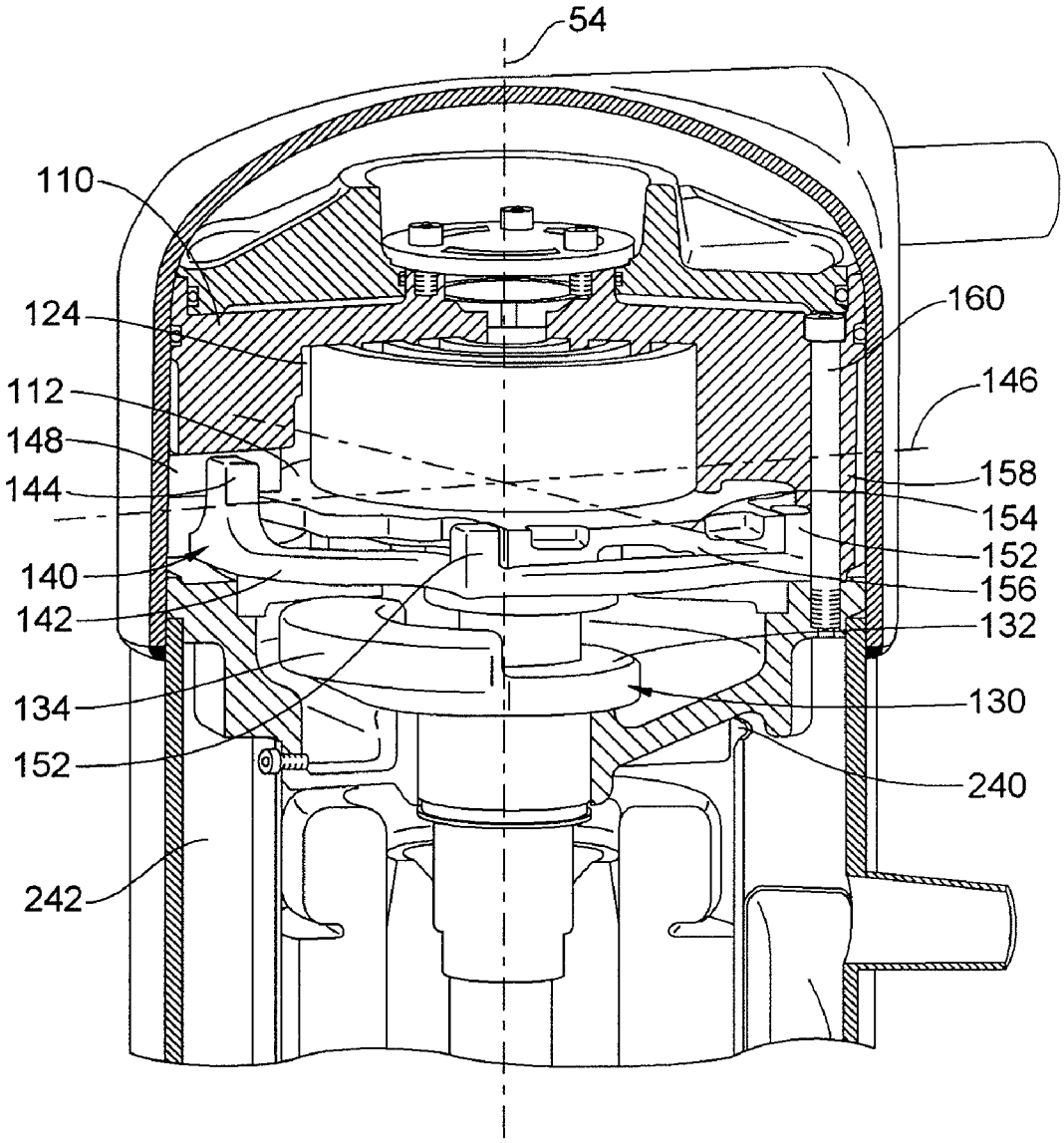
FIG. 2 is a partial cross section and cut-away view of an isometric drawing of an upper portion of the scroll compressor embodiment shown in FIG. 1.
Figure 3:
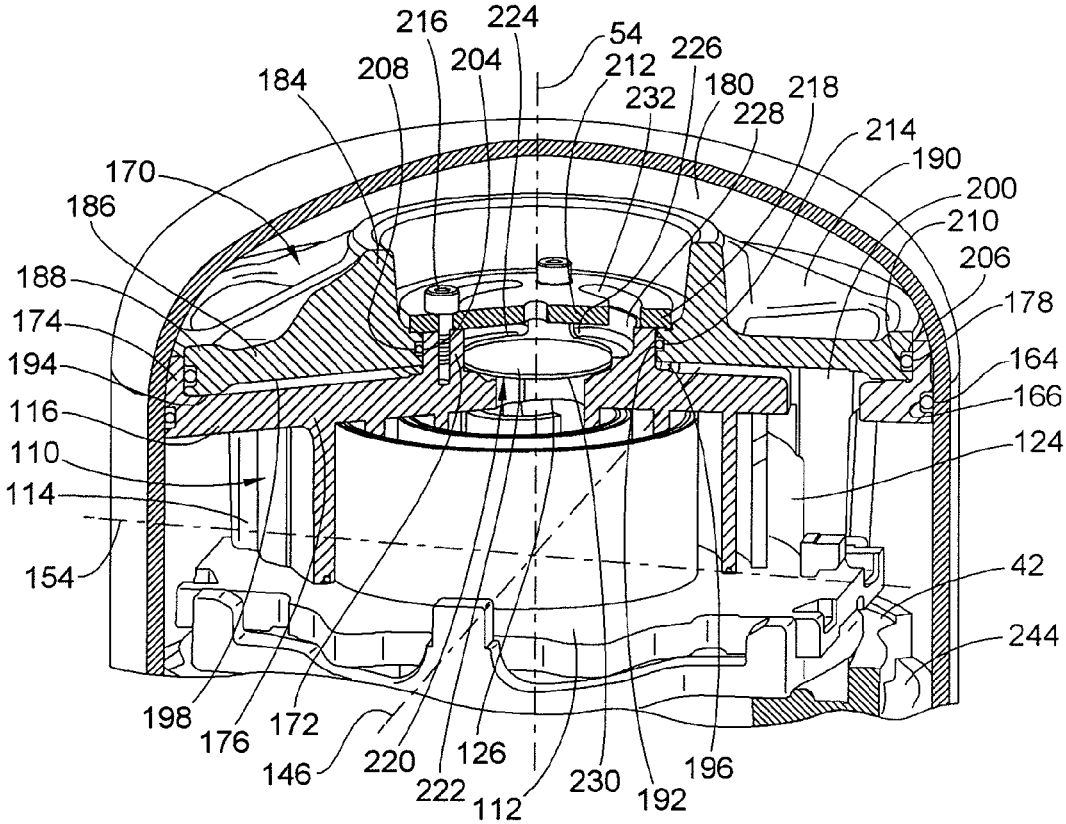
FIG. 3 is a similar view to FIG. 2 but enlarged and taken about a different angle and section in order to show other structural features.

With reference to FIGS. 1-3, and particularly FIG. 2, the guiding movement of the scroll compressor can be seen. To guide the orbital movement of the movable scroll compressor body 112 relative to the fixed scroll compressor body 110, an appropriate key coupling 140 may be provided. Keyed couplings are often referred to in the scroll compressor art as an "Oldham Coupling." In this embodiment, the key coupling 140 includes an outer ring body 142 and includes two first keys 144 that are linearly spaced along a first lateral axis 146 and that slide closely and linearly within two respective keyway tracks 148 that are linearly spaced and aligned along the first axis 146 as well. The key way tracks 148 are defined by the stationary fixed scroll compressor body 110 such that the linear movement of the key coupling 140 along the first lateral axis 146 is a linear movement relative to the outer housing 12 and perpendicular to the central axis 54. The keys can comprise slots, grooves or, as shown, projections which project from the ring body 142 of the key coupling 140. This control of movement over the first lateral axis 146 guides part of the overall orbital path of the moveable scroll compressor body 112.

Additionally, the key coupling includes four second keys 152 in which opposed pairs of the second keys 152 are linearly aligned substantially parallel relative to a second traverse lateral axis 154 that is perpendicular to the first lateral axis 146. There are two sets of the second keys 152 that act cooperatively to receive projecting sliding guide portions 156 that project from the base 120 on opposite sides of the movable scroll compressor body 112. The guide portions 156 linearly engage and are guided for linear movement along the second traverse lateral axis by virtue of sliding linear guiding movement of the guide portions 156 along sets of the second keys 152.

By virtue of the key coupling 140, the moveable scroll compressor body 112 has movement restrained relative to the fixed scroll compressor body 110 along the first lateral axis 146 and second traverse lateral axis 154. This results in the prevention of any relative rotation of the moveable scroll body as it allows only translational motion. More particularly, the fixed scroll compressor body 110 limits motion of the key coupling 140 to linear movement along the first lateral axis 146; and in turn, the key coupling 140 when moving along the first lateral axis 146 carries the moveable scroll 112 along the first lateral axis 146 therewith. Additionally, the movable scroll compressor body can independently move relative to the key coupling 140 along the second traverse lateral axis 154 by virtue of relative sliding movement afforded by the guide portions 156 which are received and slide between the second keys 152. By allowing for simultaneous movement in two mutually perpendicular axes 146, 154, the eccentric motion that is afforded by the eccentric offset drive section 74 of the drive shaft 46 upon the cylindrical drive hub 128 of the movable scroll compressor body 112 is translated into an orbital path movement of the movable scroll compressor body 112 relative to the fixed scroll compressor body 110.

Referring in greater detail to the fixed scroll compressor body 110, this body 110 is fixed to the upper bearing member 42 by an extension extending axially and vertically therebetween and around the outside of the moveable scroll compressor body 112. In the illustrated embodiment, the fixed scroll compressor body 110 includes a plurality of axially projecting legs 158 (see FIG. 2) projecting on the same side as the scroll rib from the base 116. These legs 158 engage and are seated against the top side of the upper bearing member 42. Preferably, bolts 160 (FIG. 2) are provided to fasten the fixed scroll compressor body 110 to the upper bearing member 42. The bolts 160 extend axially through the legs 158 of the fixed scroll compressor body and are fastened and screwed into corresponding threaded openings in the upper bearing member 42. For further support and fixation of the fixed scroll compressor body 110, the outer periphery of the fixed scroll compressor body includes a cylindrical surface 162 that is closely received against the inner cylindrical surface of the outer housing 10 and more particularly the top end housing section 26. A clearance gap between surface 162 and side wall 32 serves to permit assembly of upper housing 26 over the compressor assembly and subsequently to contain the o-ring seal 164. An O-ring seal 164 seals the region between the cylindrical locating surface 162 and the outer housing 112 to prevent a leak path from compressed high pressure fluid to the un-compressed section/sump region inside of the outer housing 12. The seal 164 can be retained in a radially outward facing annular groove 166.

With reference to FIGS. 1-3 and particularly FIG. 3, the upper side (e.g. the side opposite the scroll rib) of the fixed scroll 110 supports a floatable baffle member 170. To accommodate the same, the upper side of the fixed scroll compressor body 110 includes an annular and more specifically cylindrical inner hub region 172 and an outwardly spaced peripheral rim 174 which are connected by radially extending disc region 176 of the base 116. Between the hub 172 and the rim 174 is provided an annular piston-like chamber 178 into which the baffle member 170 is received. With this arrangement, the combination of the baffle member 170 and the fixed scroll compressor body 110 serve to separate a high pressure chamber 180 from lower pressure regions within the housing 10. While the baffle member 170 is shown as engaging and constrained radially within the outer peripheral rim 174 of the fixed scroll compressor body 110, the baffle member 170 could alternatively be cylindrically located against the inner surface of the outer housing 12 directly.

As shown in the embodiment, and with particular reference to FIG. 3, the baffle member 170 includes an inner hub region 184, a disc region 186 and an outer peripheral rim region 188. To provide strengthening, a plurality of radially extending ribs 190 extending along the top side of the disc region 186 between the hub region 184 and the peripheral rim region 188 may be integrally provided and are preferably equally angularly spaced relative to the central axis 54. The baffle member 170 in addition to tending to separate the high pressure chamber 180 from the remainder of the outer housing 12 also serves to transfer pressure loads generated by high pressure chamber 180 away from the inner region of the fixed scroll compressor body 110 and toward the outer peripheral region of the fixed scroll compressor body 110. At the outer peripheral region, pressure loads can be transferred to and carried more directly by the outer housing 12 and therefore avoid or at least minimize stressing components and substantially avoid deformation or deflection in working components such as the scroll bodies. Preferably, the baffle member 170 is floatable relative to the fixed scroll compressor body 110 along the inner peripheral region. This can be accomplished, for example, as shown in the illustrated embodiment by a sliding cylindrical interface 192 between mutually cylindrical sliding surfaces of the fixed scroll compressor body and the baffle member along the respective hub regions thereof. As compressed high pressure refrigerant in the high pressure chamber 180 acts upon the baffle member 170, substantially no load may be transferred along the inner region, other than as may be due to frictional engagement. Instead, an axial contact interface ring 194 is provided at the radial outer periphery where the respective rim regions are located for the fixed scroll compressor body 110 and the baffle member 170. Preferably, an annular axial gap 196 is provided between the innermost diameter of the baffle member 170 and the upper side of the fixed scroll compressor body 110. The annular axial gap 196 is defined between the radially innermost portion of the baffle member and the scroll member and is adapted to decrease in size in response to a pressure load caused by high pressure refrigerant compressed within the high pressure chamber 180. The gap 196 is allowed to expand to its relaxed size upon relief of the pressure and load.

To facilitate load transfer most effectively, an annular intermediate or lower pressure chamber 198 is defined between the baffle member 170 and the fixed scroll compressor body 110. This intermediate or lower pressure chamber can be subject to either the lower sump pressure as shown, or can be subject to an intermediate pressure (e.g. through a fluid communication passage defined through the fixed scroll compressor body to connect one of the individual compression chambers 122 to the chamber 198). Load carrying characteristics can therefore be configured based on the lower or intermediate pressure that is selected for best stress/deflection management. In either event, the pressure contained in the intermediate or low pressure chamber 198 during operation is substantially less than the high pressure chamber 180 thereby causing a pressure differential and load to develop across the baffle member 170.

To prevent leakage and to better facilitate load transfer, inner and outer seals 204, 206 may be provided, both of which may be resilient, elastomeric O-ring seal members. The inner seal 204 is preferably a radial seal and disposed in a radially inwardly facing inner groove 208 defined along the inner diameter of the baffle member 170. Similarly the outer seal 206 can be disposed in a radially outwardly facing outer groove 210 defined along the outer diameter of the baffle member 170 in the peripheral rim region 188. While a radial seal is shown at the outer region, alternatively or in addition an axial seal may be provided along the axial contact interface ring 194.

While the baffle member 170 could be a stamped steel component, preferably and as illustrated, the baffle member 170 comprises a cast and/or machined member (and may be aluminum) to provide for the expanded ability to have several structural features as discussed above. By virtue of making the baffle member in this manner, heavy stamping of such baffles can be avoided.

Additionally, the baffle member 170 can be retained to the fixed scroll compressor body 110. Specifically, as can be seen in the figures, a radially inward projecting annular flange 214 of the inner hub region 184 of the baffle member 170 is trapped axially between the stop plate 212 and the fixed scroll compressor body 110. The stop plate 212 is mounted with bolts 216 to a fixed scroll compressor body 210. The stop plate 212 includes an outer ledge 218 that projects radially over the inner hub 172 of the fixed scroll compressor body 110. The stop plate ledge 218 serves as a stop and retainer for the baffle member 170. In this manner, the stop plate 212 serves to retain the baffle member 170 to the fixed scroll compressor body 110 such that the baffle member 170 is carried thereby.

As shown, the stop plate 212 can be part of a check valve 220. The check valve includes a moveable valve plate element 222 contained within a chamber defined in the outlet area of the fixed scroll compressor body within the inner hub 172. The stop plate 212 thus closes off a check valve chamber 224 in which the moveable valve plate element 222 is located. Within the check valve chamber there is provided a cylindrical guide wall surface 226 that guides the movement of the check valve 220 along the central axis 54. Recesses 228 are provided in the upper section of the guide wall 226 to allow for compressed refrigerant to pass through the check valve when the moveable valve plate element 222 is lifted off of the valve seat 230. Openings 232 are provided in the stop plate 212 to facilitate passage of compressed gas from the scroll compressor into the high pressure chamber 180. The check valve is operable to allow for one way directional flow such that when the scroll compressor is operating, compressed refrigerant is allowed to leave the scroll compressor bodies through the compression outlet 126 by virtue of the valve plate element 222 being driven off of its valve seat 230. However, once the drive unit shuts down and the scroll compressor is no longer operating, high pressure contained within the high pressure chamber 180 forces the movable valve plate element 222 back upon the valve seat 230. This closes off check valve 220 and thereby prevents backflow of compressed refrigerant back through the scroll compressor.

During operation, the scroll compressor assembly 10 is operable to receive low pressure refrigerant at the housing inlet port 18 and compress the refrigerant for delivery to the high pressure chamber 180 where it can be output through the housing outlet port 20. As is shown, in FIG. 4, an internal conduit 234 can be connected internally of the housing 12 to guide the lower pressure refrigerant from the inlet port 18 into the motor housing via a motor housing inlet 238. This allows the low pressure refrigerant to flow across the motor and thereby cool and carry heat away from the motor which can be caused by operation of the motor. Low pressure refrigerant can then pass longitudinally through the motor housing and around through void spaces therein toward the top end where it can exit through a plurality of motor housing outlets 240 (see FIG. 2) that are equally angularly spaced about the central axis 54. The motor housing outlets 240 may be defined either in the motor housing 48, the upper bearing member 42 or by a combination of the motor housing and upper bearing member (e.g. by gaps formed therebetween as shown in FIG. 2). Upon exiting the motor housing outlet 240, the low pressure refrigerant enters an annular chamber 242 formed between the motor housing and the outer housing. From there, the low pressure refrigerant can pass through the upper bearing member through a pair of opposed outer peripheral through ports 244 that are defined by recesses on opposed sides of the upper bearing member 42 to create gaps between the bearing member 42 and housing 12 as shown in FIG. 3 (or alternatively holes in bearing member 42). The through ports 244 may be angularly spaced relative to the motor housing outlets 240. Upon passing through the upper bearing member 42, the low pressure refrigerant finally enters the intake area 124 of the scroll compressor bodies 110, 112. From the intake area 124, the lower pressure refrigerant finally enters the scroll ribs 114, 118 on opposite sides (one intake on each side of the fixed scroll compressor body) and is progressively compressed through chambers 122 to where it reaches it maximum compressed state at the compression outlet 126 where it subsequently passes through the check valve 220 and into the high pressure chamber 180. From there, high pressure compressed refrigerant may then pass from the scroll compressor assembly 10 through the refrigerant housing outlet port 20.

Figure 5:
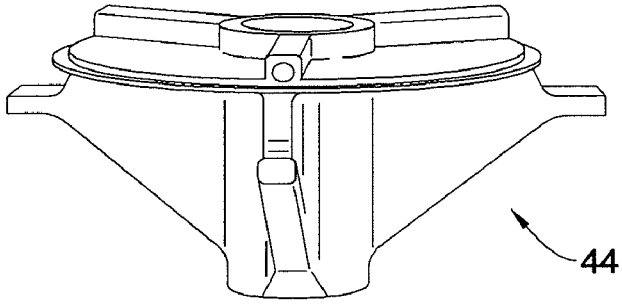
FIGS. 5-17 are isometric and/or partial cutaway views (with cutaways of certain components taken at less than 180 degrees) of the scroll compressor assembly at various stages of assembly with the progressive sequence of figures illustrating a progressive build of the overall scroll compressor assembly in accordance with an embodiment of the present invention.

Referring now to FIGS. 5-17, attention will be provided as to further details of the build assembly and support structure (e.g. for the housing, motor and/or bearing members) and ways to progressively build the scroll compressor assembly 10 as shown in the prior figures. Referring to FIG. 5, the build process can begin and be built upon the lower bearing member 44. The bearing member 44 is illustrated alone, but it is understood that it can be supported upon a fixture. The lower bearing member 44 provides a structure upon which a remainder of the components can generally be built upon.

Figure 6:
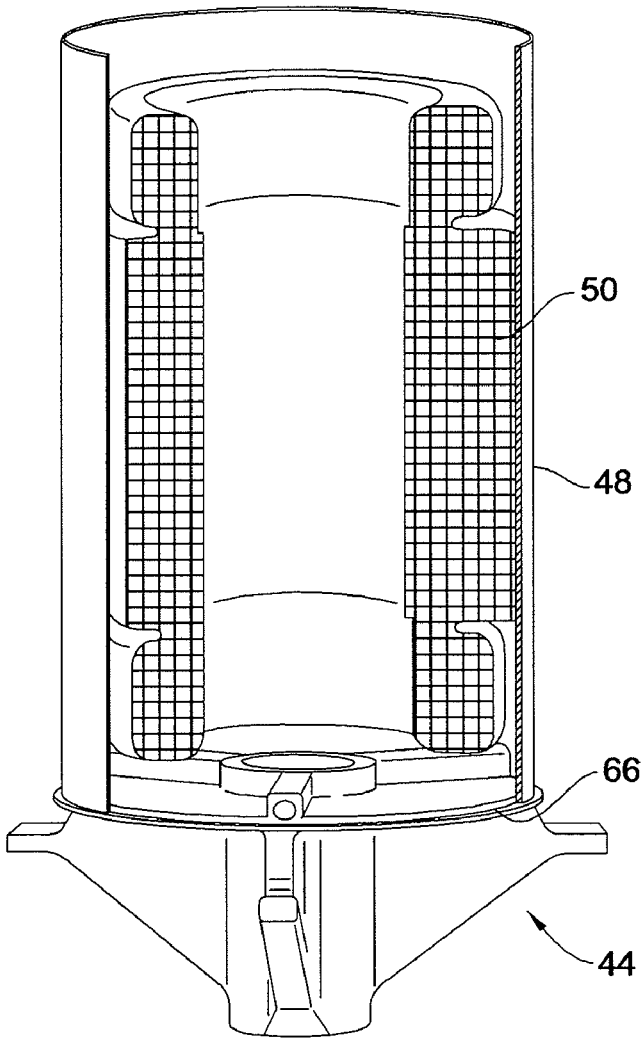

Turning to FIG. 6, the electrical motor (including motor housing 48 and stator 50 are placed vertically upon the lower bearing member 44 with the bottom edge of the motor housing 48 seated in abutting relation on the stepped seat 66 provided by the lower bearing member 44. This seat region provides for both axial and radial location and support sufficient to allow for screws to be driven in radially through the housing and into the lower bearing member 44 (see e.g. FIG. 1 where a bolt is illustrated).

Figure 7:
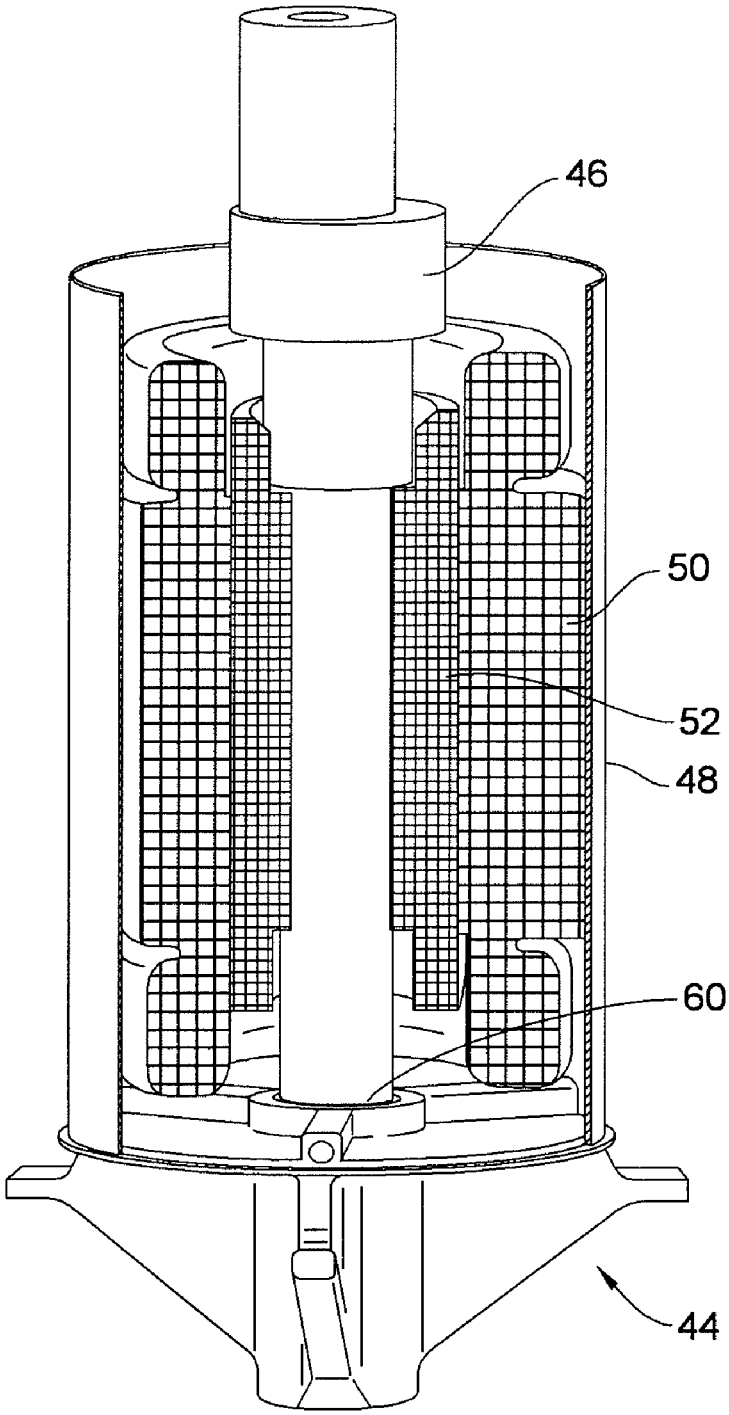

Referring to FIG. 7, the drive shaft 46 and rotor 52 (both of which may be preassembled together in a separate operation) can be installed, through the stator 50 and received into the cylindrical bearing or bushing 60 of the lower bearing member 44 where it is journalled and thereby supported for rotation. The shaft 46 is also secured to the rotor 52 by splines, keying, coupling, pressing, heat-shrinking, or otherwise such that the rotor 52 and the shaft 46 rotate in unison. As noted above, the drive shaft is preassembled with the rotor and then placed upon the lower bearing member as a unit.

Figure 8:
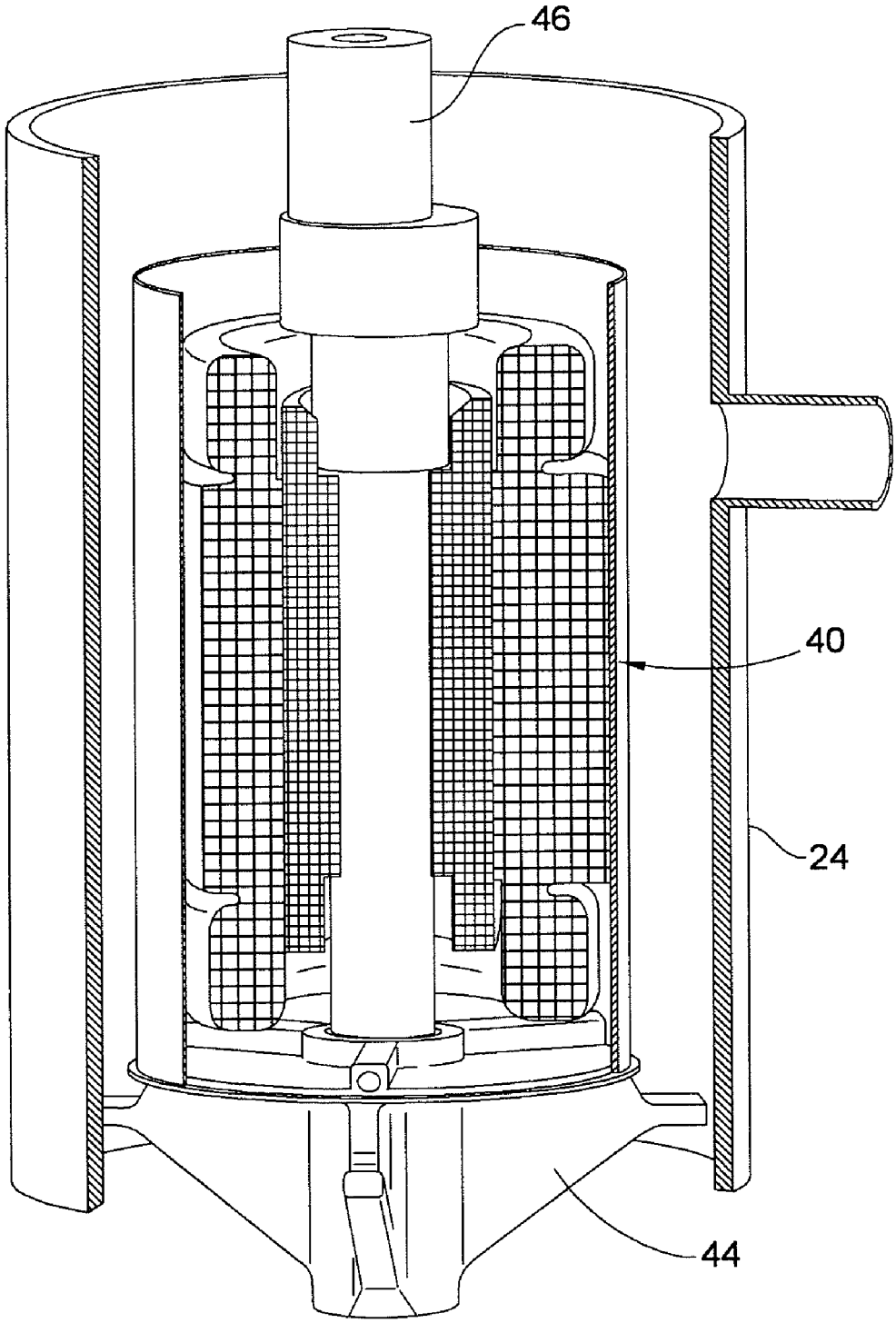

Turning to FIG. 8, the cylindrical central housing section 24 may generally be concentrically arranged around the remainder of the assembly at this stage but not coupled to anything such that the shell can be moved upwardly or downwardly to facilitate mounting of components as appropriate.

Figure 9:
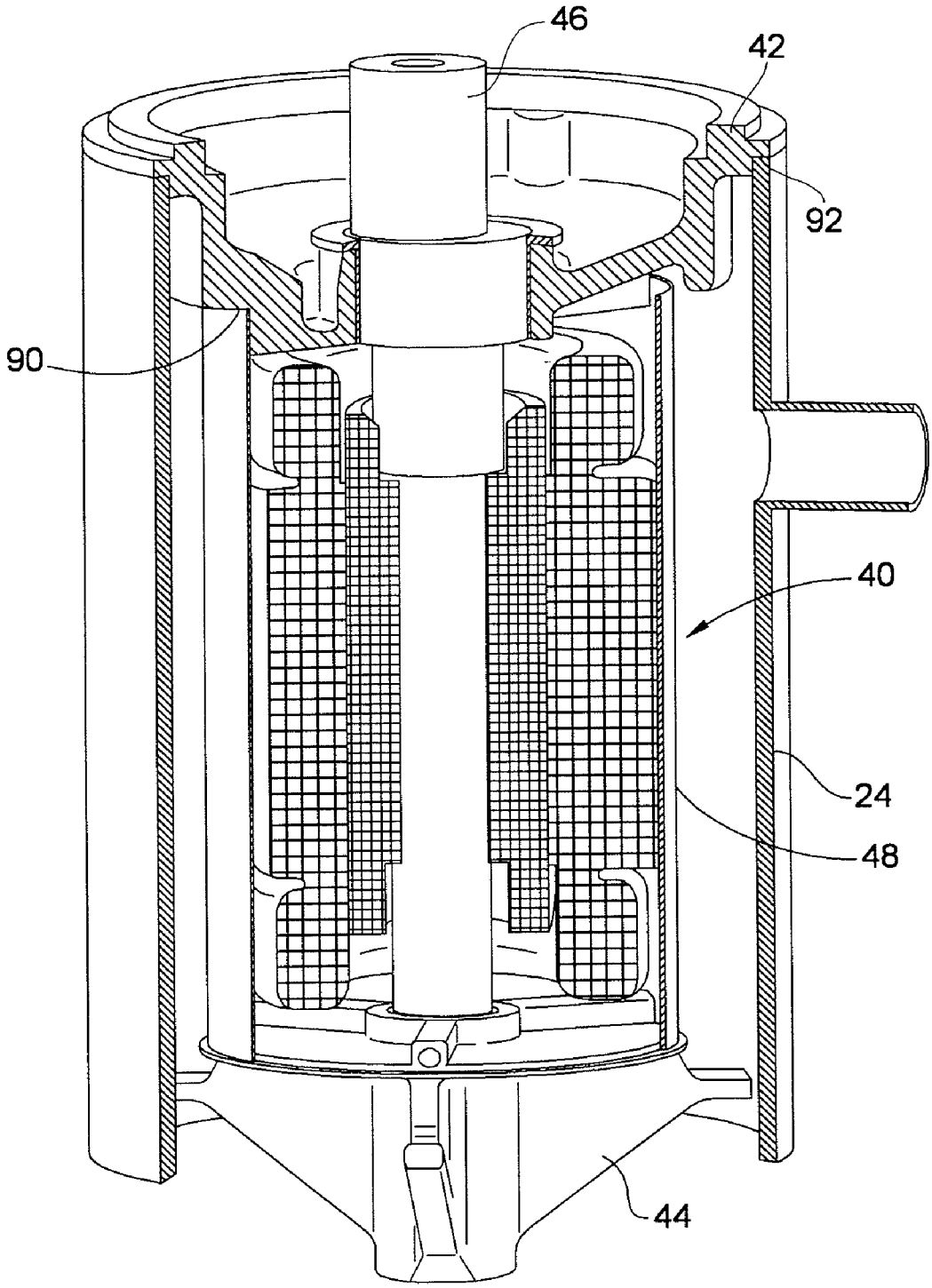

Turning then to FIG. 9, the upper bearing member 42 including its bushing or bearing is slid down upon the drive shaft and seated in axially abutting relation to the upper surface 92 of the central housing section 24, and with the top edge of the motor housing 48 seating in abutting relation to the stepped annular seating surface 90. Additionally, the housing section radially locates the upper bearing member 42. During this assembly step, the central housing section 24 can be slid downwardly initially to facilitate bolting of the upper end of the motor housing 48 to the upper bearing member 42. Additionally, optionally, the upper bearing member 42 may also be fastened by way of screws or otherwise secured to the central shell section, for example, the upper bearing member 42 may be press fit onto the upper end of the central housing section 24. The central shell section may alternatively be kept free floating at this point, in which securement between the shell and upper bearing member can be done later if desired.

Figure 10:
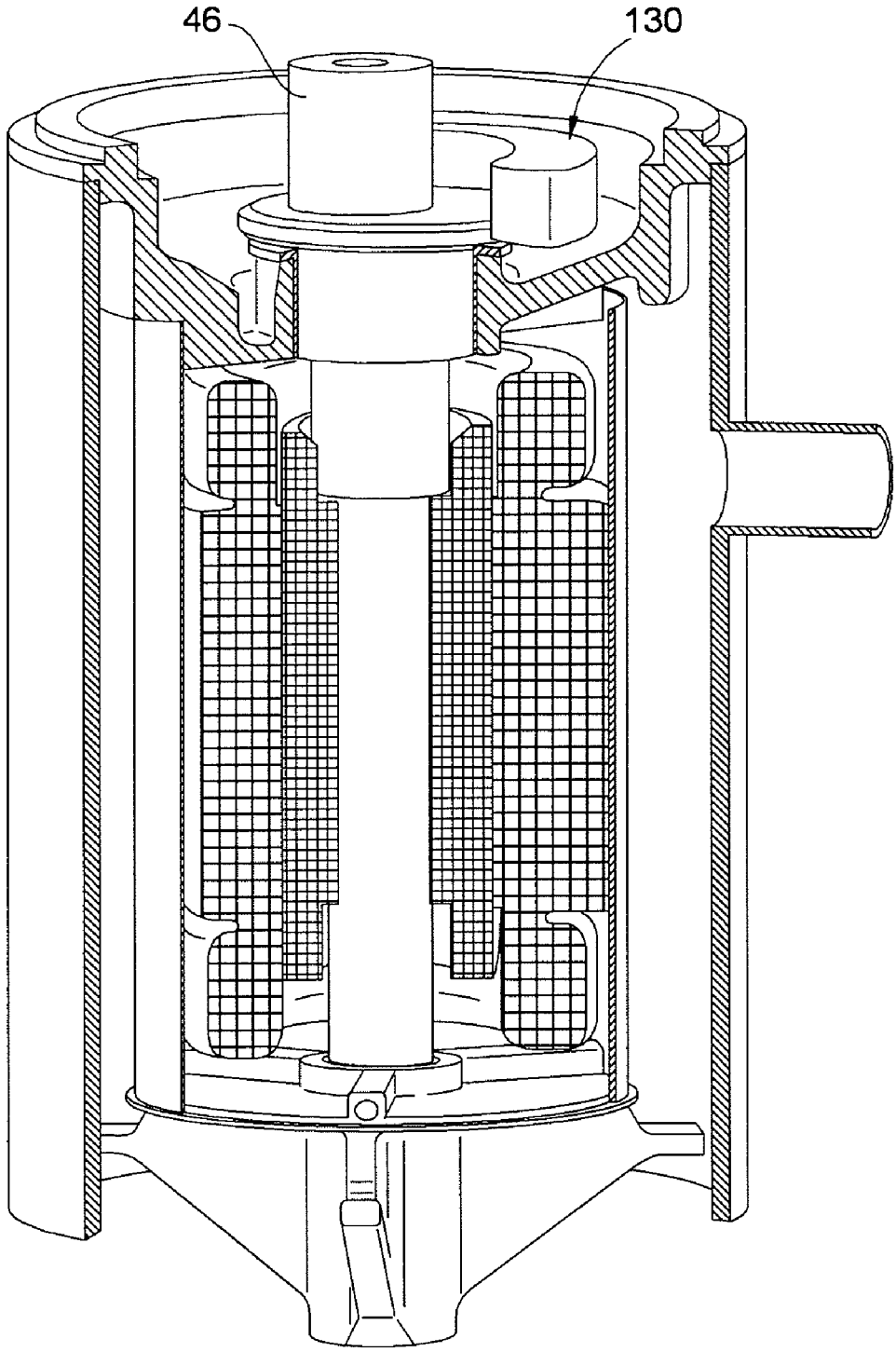

Turning to FIG. 10, the upper counterweight 130 can be slid on and fixed at a predetermined angular position on the drive shaft 46. The lower counterweight (shown in FIG. 1), can be preassembled with the motor assembly.

Figure 11:
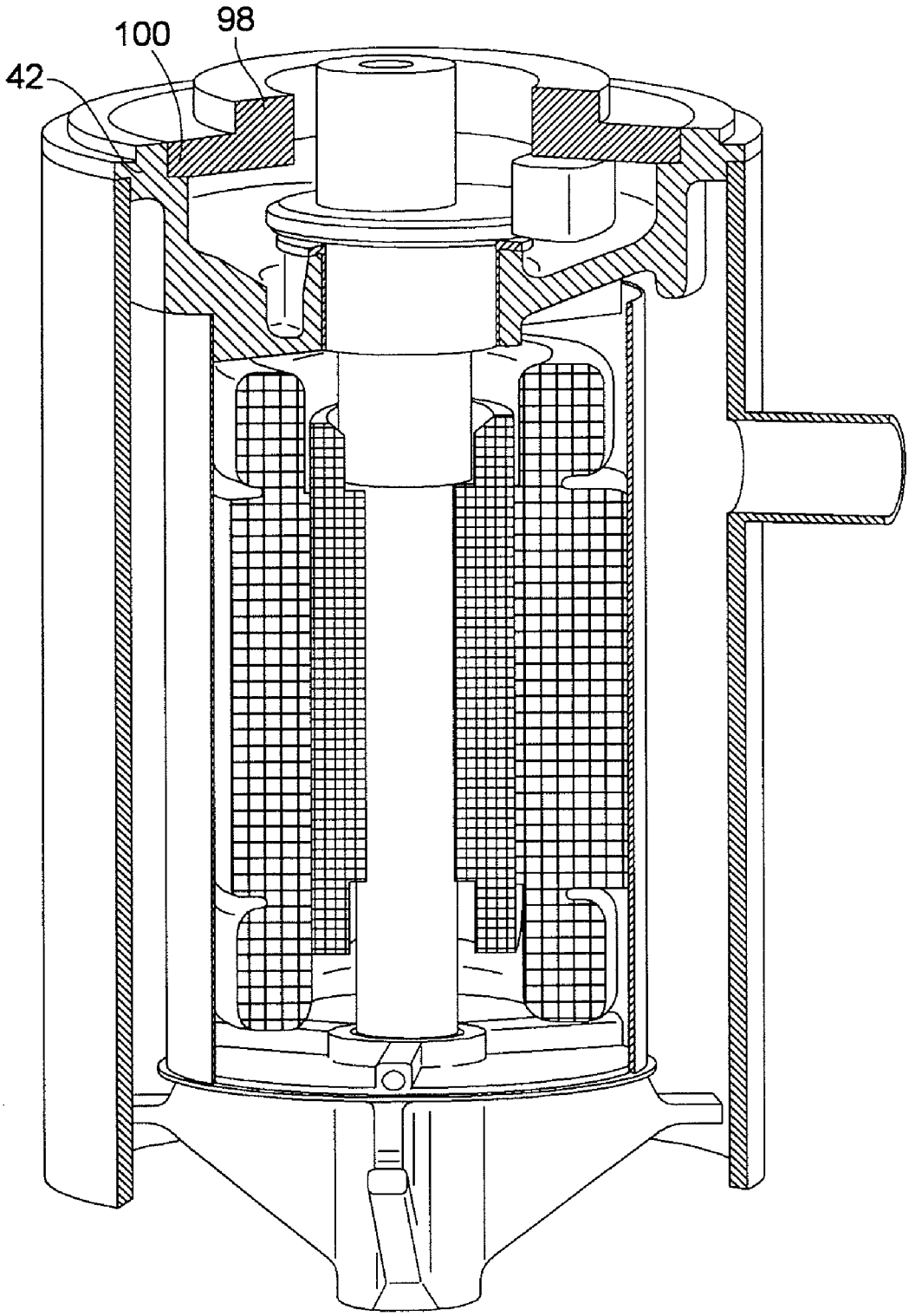

Turning next to FIG. 11, the thrust plate in the form of collar member 98 can be installed and axially and radially located and supported via stepped annular interface 100.

Figure 12:
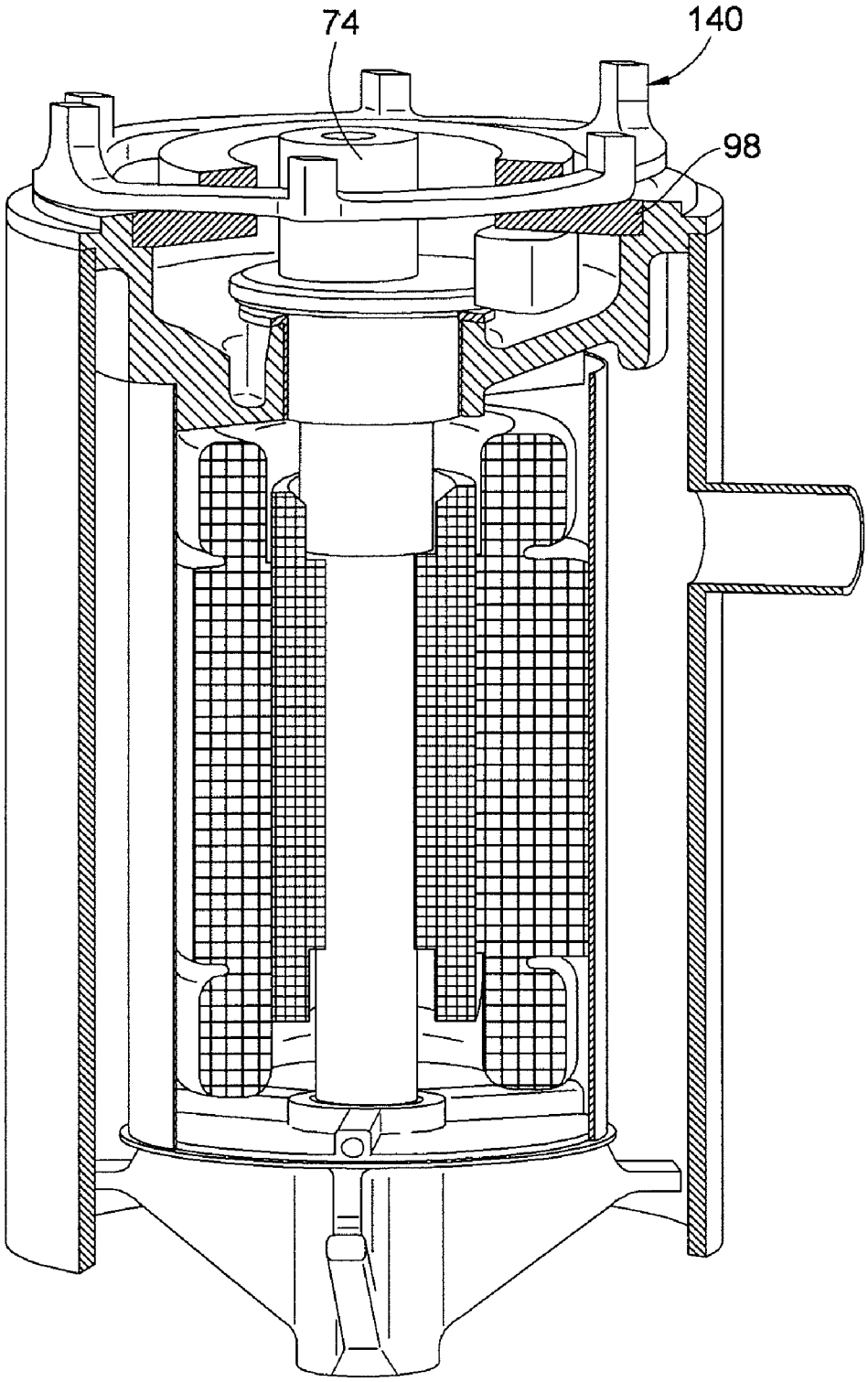

The Oldham key coupling 140 can then be placed a top the thrust plate as illustrated in FIG. 12.

Figure 13:
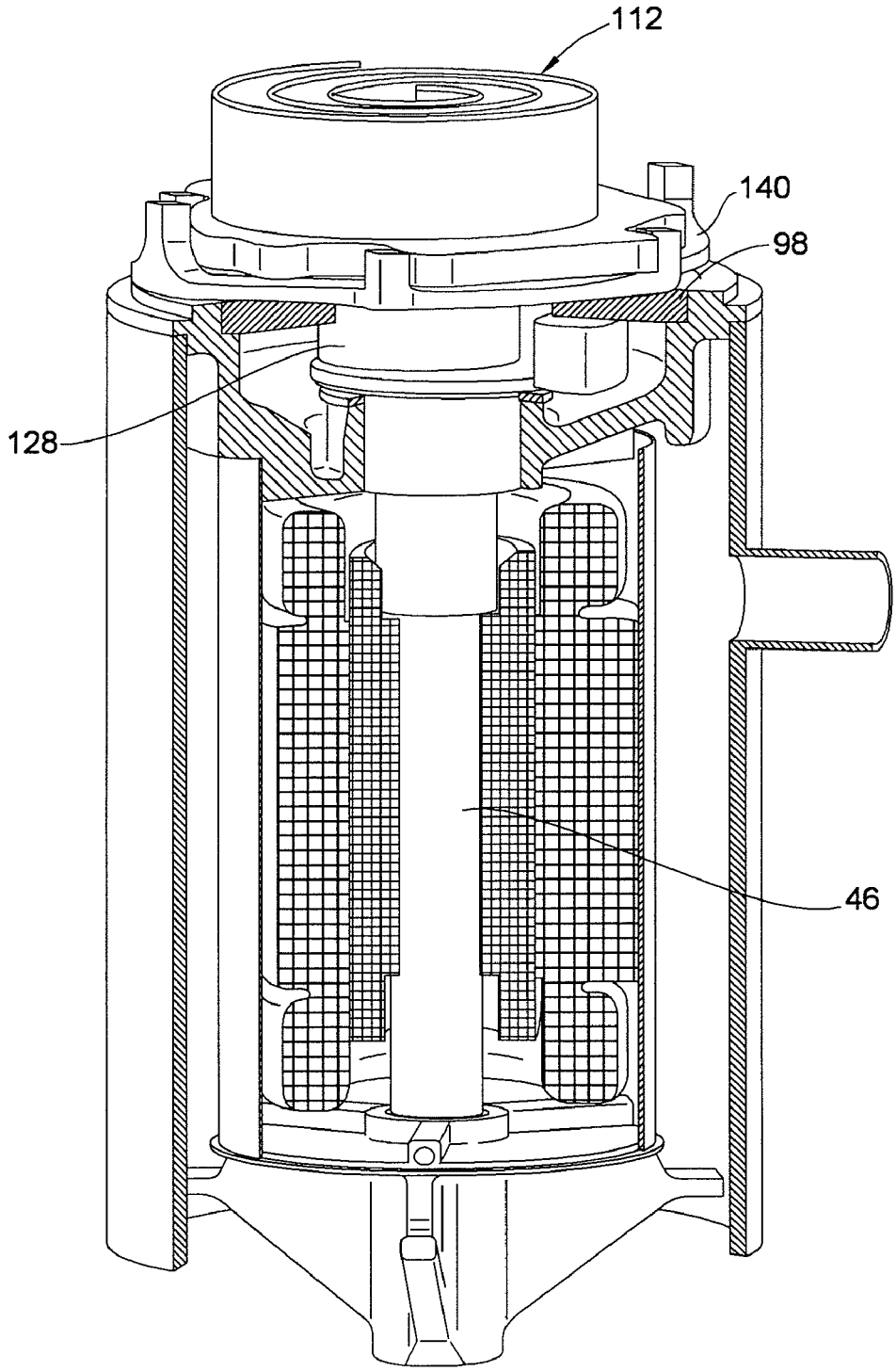

Turning to FIG. 13, the movable scroll compressor body 112 is placed in its proper location on the key coupling 140 as well as having the cylindrical drive hub 128 slidably received upon the offset drive section 74 (shown in FIG. 12) of the drive shaft.

Figure 14:
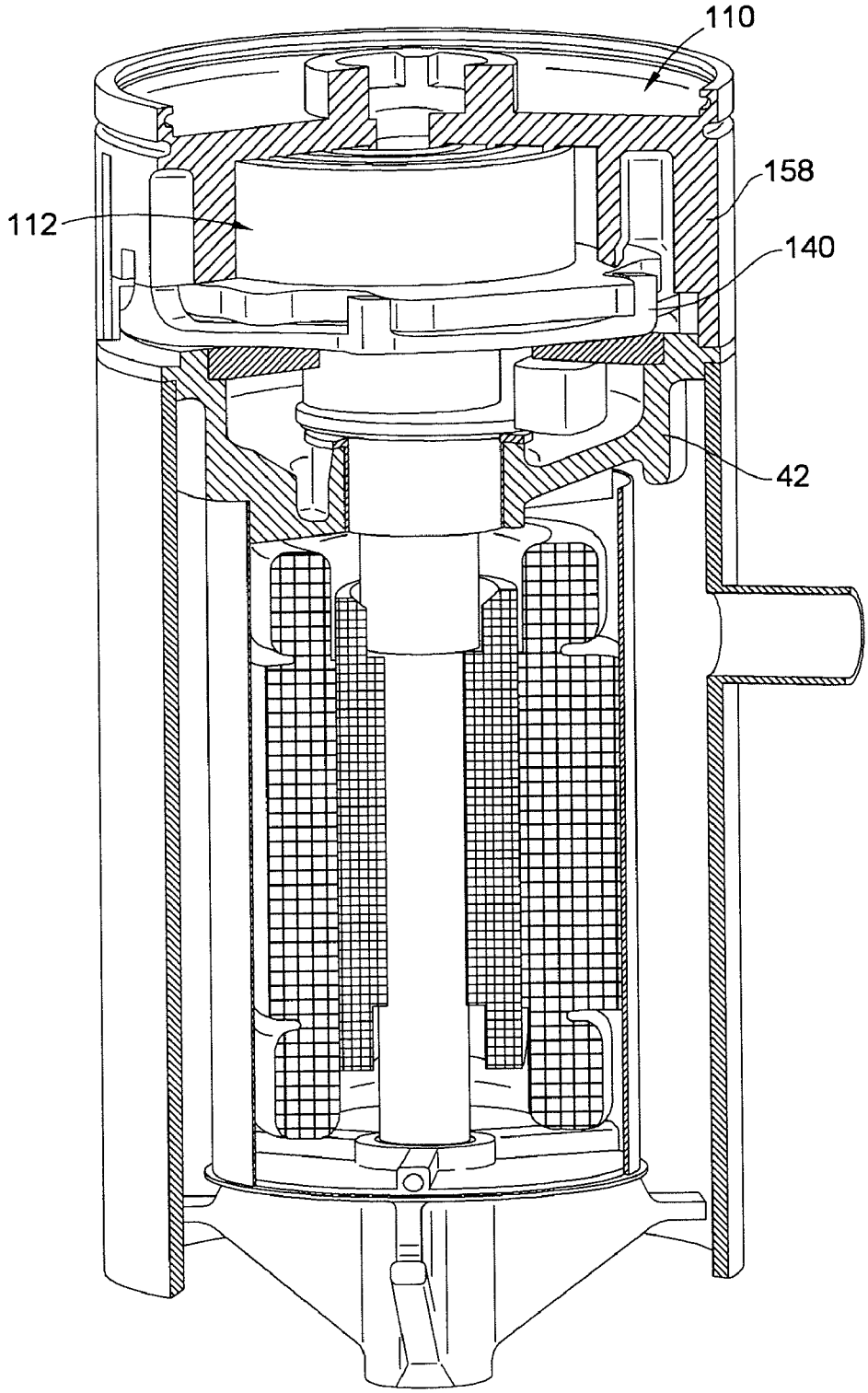

Turing next to FIG. 14, the fixed scroll compressor body 110 can then be installed onto the movable scroll compressor body 112 with the scroll ribs received in one another and the appropriate keys of the key coupling 140 received in the keyway provided by the fixed scroll compressor body. At this point, bolts can be axially driven through the legs 158 of the fixed scroll compressor body 110 to affix the scroll compressor body 110 to the upper bearing member 42 (see e.g. FIG. 2).

Figure 15:
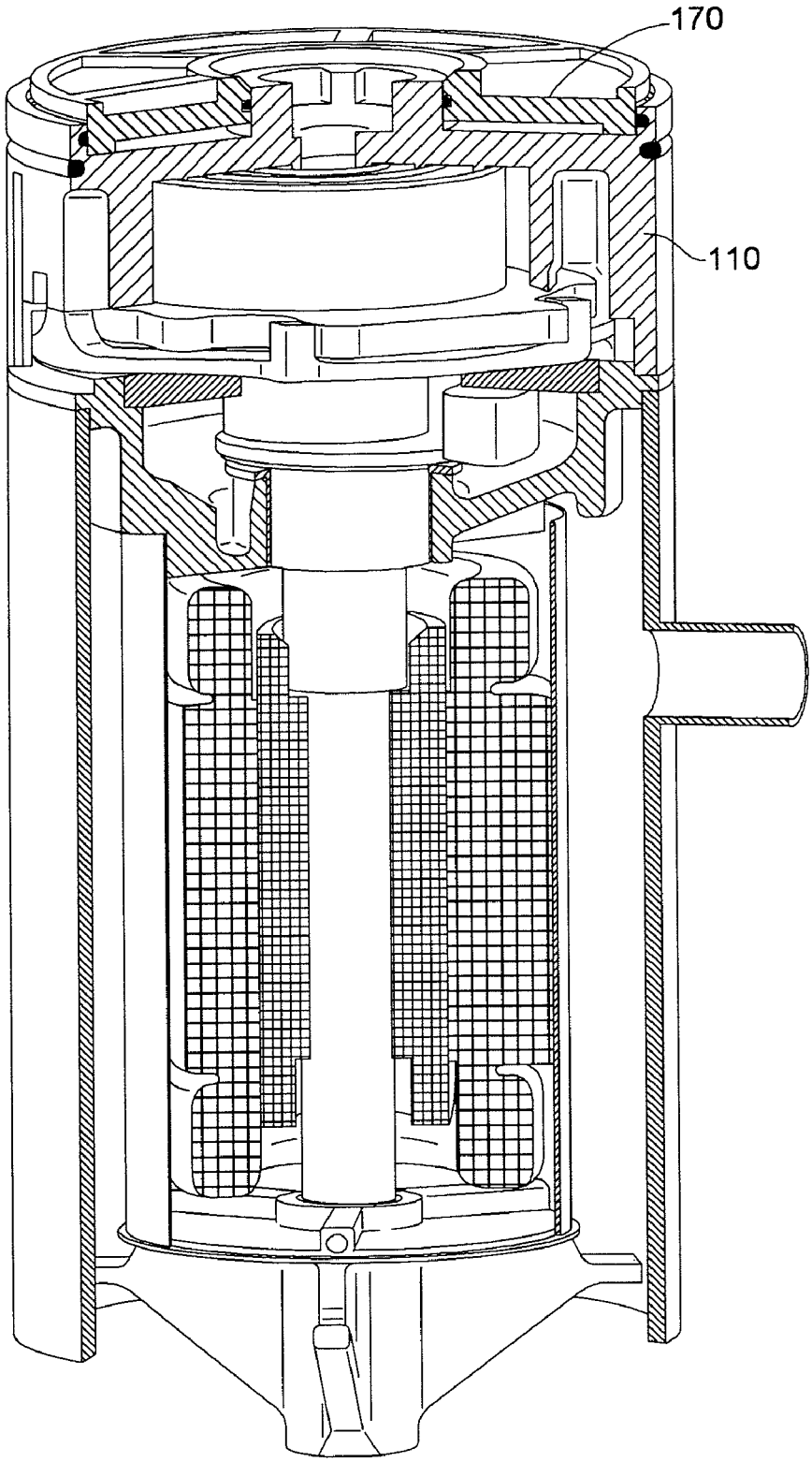
Figure 16:
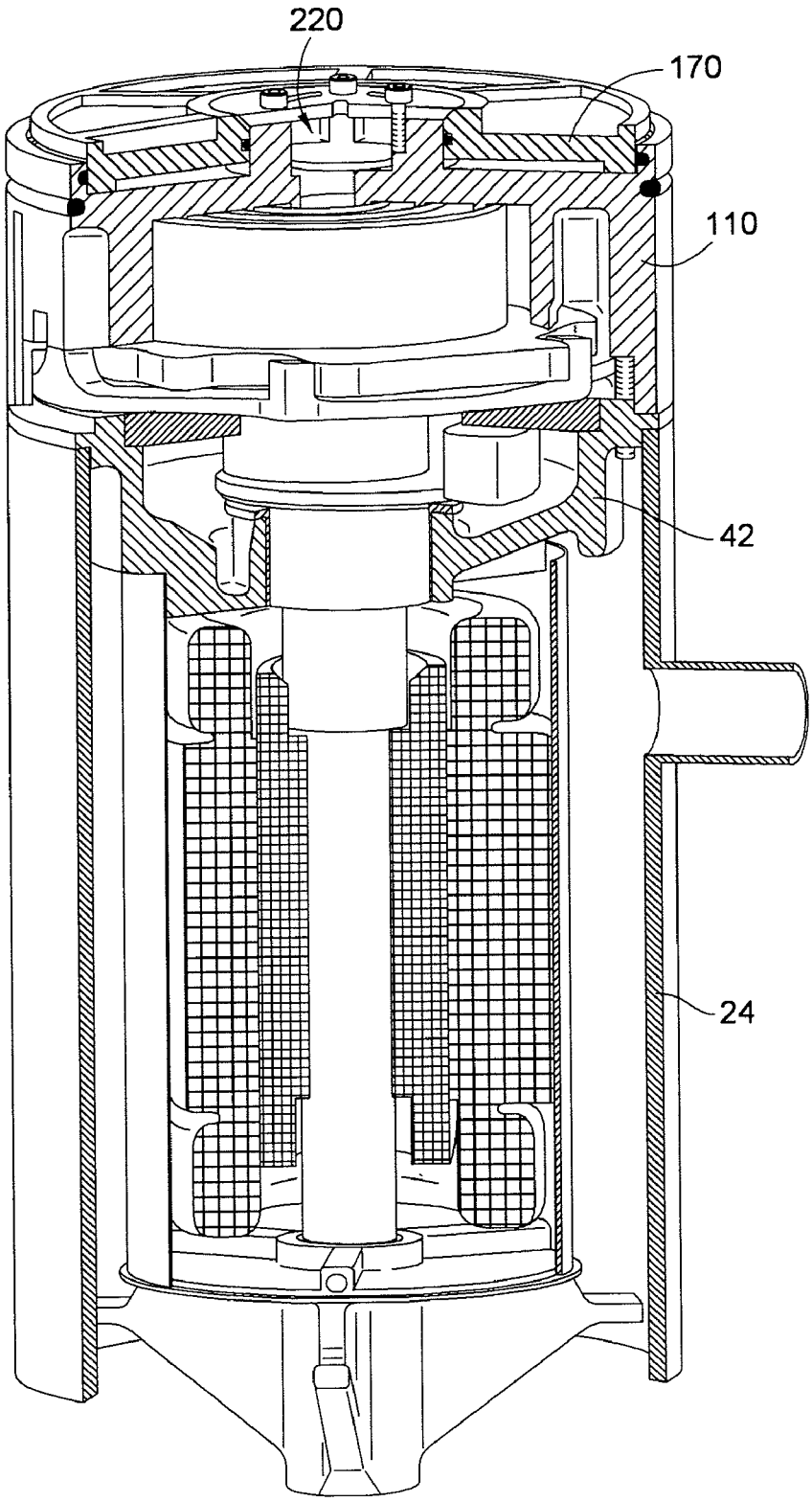

Next, as shown in FIG. 15, the baffle plate 170 can be installed and then the check valve 220 as shown in FIG. 16.

At this point the scroll compressor can be tested to ensure operation. Wiring (not shown) has been run through the assembly at this point through an electrical port as is known. Also, if not done earlier, the central shell housing section 24 can be moved up into engagement for axially and radially locating and supporting the upper bearing member 42, if this has not been accomplished previously. At this point, testing of the motor will typically be done to ensure proper operation of the overall scroll compressor assembly.

Figure 17:
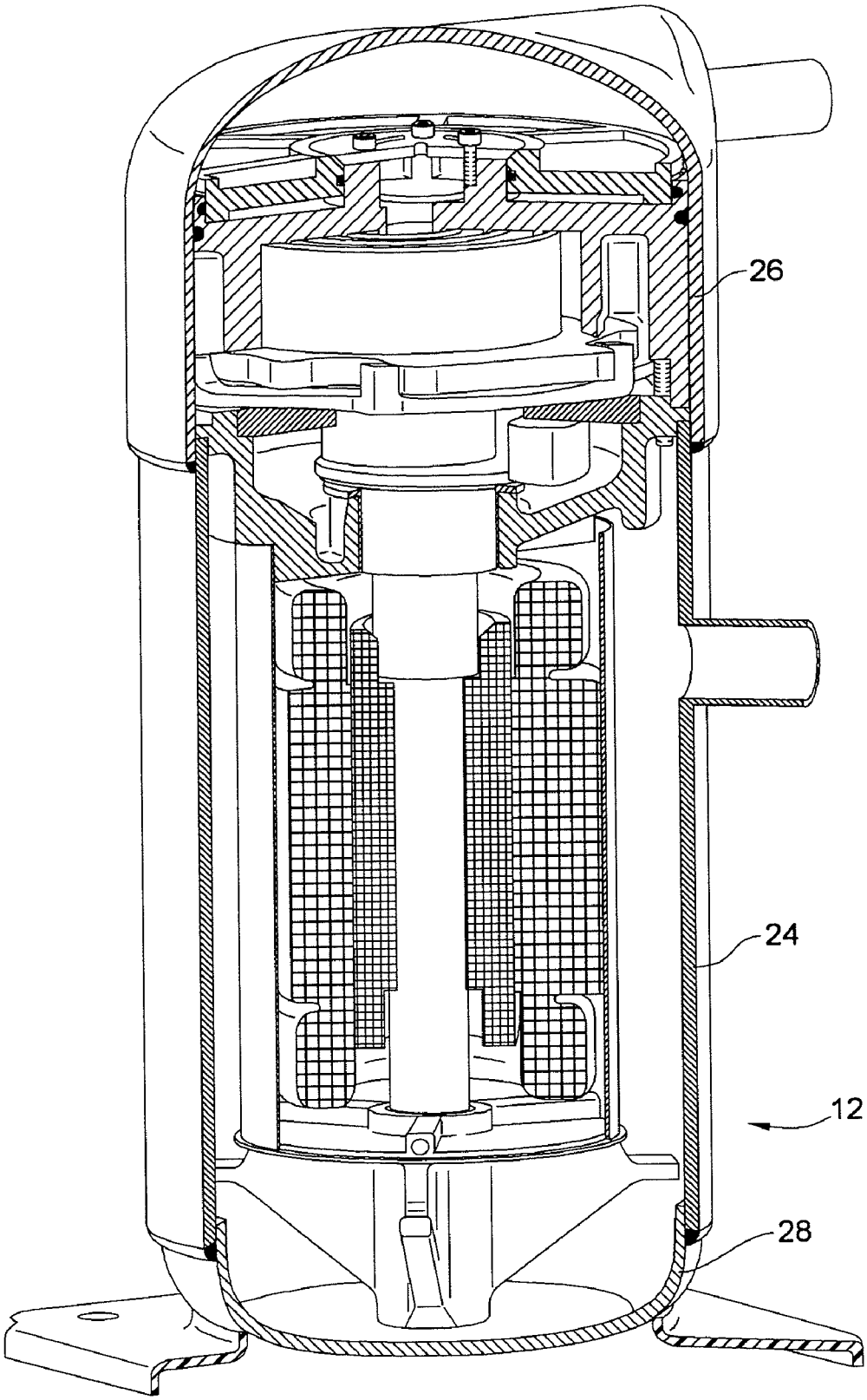

Thereafter, a conduit 234 (see FIG. 4) may be installed through the bottom end of the housing to route incoming refrigerant through the motor. Alternatively, the motor housing may engage the outer housing (or a member provided therebetween) to have a similar effect of causing refrigerant to run through the motor housing. The upper and lower shell housing sections 26, 28 can then be telescopically interfitted upon the upper and lower ends of the central housing section 24. As can be seen in FIG. 17, the upper housing section 26 telescopically fits over the outer circumference of the central shell section while the lower housing section 28 telescopically fits inside of the central housing section 24. Circumferential welds extending all of the way around the housing secure each of the housing sections 24, 26, 28 together to form an enclosure for the internal scroll compressor assembly components.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A scroll compressor, comprising:

a housing including a first and second shell sections that are telescopically interfitted to define a first annular seat internal to the housing;

scroll compressor bodies having respective bases and respective scroll ribs that project from the respective bases and which mutually engage;

a motor providing a rotational output on a drive shaft, the drive shaft operatively driving one of the scroll compressor bodies to facilitate relative movement for the compression of fluid;

a lower bearing member rotatably supporting the drive shaft, the lower bearing member engaging the first annular seat; and wherein the first and second shell sections include a tubular central shell section having opposed open ends and a lower shell section, the lower shell section received inside of the central shell section to provide a circular edge that provides the first annular seat and axially abuts the lower bearing member;

wherein the lower shell section includes an end wall and a cylindrical sidewall extending integrally from the end wall, wherein the lower bearing member is located radially against an inner cylindrical surface of the cylindrical sidewall of the lower shell section; and wherein the housing further includes a third shell section that is an upper shell section, the tubular central shell section received inside of the upper shell section to provide a circular edge that provides a second seat that axially abuts an upper bearing member.

2. The scroll compressor of claim 1, wherein the first annular seat provides for axial location and support of the lower bearing member.

3. The scroll compressor of claim 1, wherein the lower bearing member includes a central hub having a central opening having a bearing receiving the drive shaft and a plurality of arms projecting radially outwardly from the inner hub, each of the arms being seated upon the first annular seat.

4. The scroll compressor of claim 1, further including a motor housing supporting the motor, the motor housing supported by the lower bearing member in spaced relation to the first, second, and third shell sections of the housing such that the motor housing does not contact the first, second, and third shell sections of the housing.

5. A scroll compressor, comprising:

a housing including a first, second, and third shell sections that are telescopically interfitted to define a first and second annular seats internal to the housing;

scroll compressor bodies having respective bases and respective scroll ribs that project from the respective bases and which mutually engage;

a motor providing a rotational output on a drive shaft, the drive shaft operatively driving one of the scroll compressor bodies to facilitate relative movement for the compression of fluid;

a lower bearing member rotatably supporting the drive shaft, the lower bearing member engaging the first annular seat;

wherein the first and second shell sections include a tubular central shell section having opposed open ends and a upper shell section, the central shell section received inside of the upper shell section to provide a circular edge that provides the second annular seat and axially abuts an upper bearing member; and wherein the upper bearing member is radially located against an inner surface of the central shell section.

6. A scroll compressor, comprising:

a housing including a first, second, and third shell sections that are telescopically interfitted to define a first and second annular seats internal to the housing;

scroll compressor bodies having respective bases and respective scroll ribs that project from the respective bases and which mutually engage;

a motor providing a rotational output on a drive shaft, the drive shaft operatively driving one of the scroll compressor bodies to facilitate relative movement for the compression of fluid;

a lower bearing member rotatably supporting the drive shaft, the lower bearing member engaging the first annular seat; and an upper bearing member, wherein the first and second shell sections include a tubular central shell section having opposed open ends and a lower shell section, the lower shell section received inside of the central shell section to provide a first circular edge that provides the first annular seat and axially abuts the lower bearing member, wherein the upper bearing member is radially located against an inner surface of the central shell section and the central shell section further provides a second annular seat that axially abuts the upper bearing member.

7. The scroll compressor of claim 6, further including an upper shell section telescopically interfitted over the central shell section.

8. A scroll compressor, comprising:

a housing including an upper shell section, a lower shell section and a tubular central shell section, the upper and lower shell sections telescopically interfitted with opposed ends of the tubular central shell section;

scroll compressor bodies enclosed in the housing, the scroll compressor bodies having respective bases and respective scroll ribs that project from the respective bases and which mutually engage; and a drive unit enclosed in the housing providing a rotational output toward the scroll compressor bodies to facilitate relative movement for the compression of fluid;

wherein the upper shell section includes a closed upper end and a generally cylindrical, downwardly depending sidewall, and wherein the lower shell section includes a lower closed end and a generally cylindrical, upwardly depending sidewall, wherein first and second outer circumferential welds secure the respective sidewalls to upper and lower ends of the tubular central shell section; and further including upper and lower bearing members, the drive unit including a motor having the rotational output on a drive shaft, the drive shaft rotatably supported by the upper and lower bearing members, wherein the upper and lower bearing members are seated upon first and second seats provided by internal edges of the central and lower shell sections, respectively; and wherein the internal edges axially locate and support the upper and lower bearing members, wherein the lower bearing member is located radially against an inner surface of the lower shell section and wherein the upper bearing member is located radially against an inner surface of the central shell section.

9. The scroll compressor of claim 8, wherein the central shell section is telescopically received inside of the upper shell section.

10. The scroll compressor of claim 9, wherein the lower shell section is telescopically received inside the central shell section.

11. The scroll compressor of claim 8, wherein the housing consists of only three components for creating an internal scroll compressor compartment, namely the upper shell section, the lower shell section and the tubular central shell section.

12. The scroll compressor of claim 8, further comprising a motor housing for the motor, the upper and lower bearing members defining annular stepped seated regions locating the motor housing axially and radially, respectively.

13. The scroll compressor of claim 12, further comprising bolts fastening the motor housing to the upper and lower bearing members, the bolts being mounted in a radially inward direction.

* * * * *